United States Patent [19]

Bergersen

[11] Patent Number: 4,979,925

[45] Date of Patent: Dec. 25, 1990

[54] LIVING HINGE BOX WITH REMOVABLE AND INTERCHANGEABLE TOP AND BOTTOM

[75] Inventor: Earl O. Bergersen, 950 Green Bay Rd., Winnetka, Ill. 60093

[73] Assignee: Earl O. Bergersen, Winnekta, Ill.

[21] Appl. No.: 368,556

[22] Filed: Jun. 20, 1989

[51] Int. Cl.[5] ..... A63H 3/28; A63H 5/00

[52] U.S. Cl. ..... 446/297; 446/404; 446/420

[58] Field of Search ..... 446/22, 23, 69, 71, 446/72, 73, 77, 81, 268, 297, 368, 371, 375, 376, 379, 380, 382, 397, 404, 406, 415, 420, , 486, 304, 417, 418, 301; 433/65; 209/235

[56] References Cited

U.S. PATENT DOCUMENTS

| | | | |
|---|---|---|---|
| 325,141 | 8/1885 | Wilke | 446/304 |
| 753,335 | 3/1904 | Ward | 446/304 X |
| 2,461,588 | 2/1949 | Cooper | 446/397 X |
| 2,564,942 | 8/1951 | Wemmer, Sr. | 446/420 |
| 3,092,927 | 6/1963 | Luchsinger | 446/397 |
| 3,538,637 | 11/1970 | Smith | 446/415 |
| 3,738,054 | 6/1973 | Petrusek | 446/304 |
| 3,909,977 | 10/1975 | Kirk | 446/418 |
| 4,019,277 | 4/1977 | Kenkelen | 446/418 X |
| 4,175,325 | 11/1979 | Beckwith | 433/65 X |
| 4,227,326 | 10/1980 | Adler | 446/418 X |
| 4,631,715 | 12/1986 | Hoover | 446/397 X |
| 4,810,228 | 3/1989 | Huggins | 446/418 |
| 4,846,104 | 7/1989 | Pierson, Jr. | 209/235 X |

FOREIGN PATENT DOCUMENTS

| | | | |
|---|---|---|---|
| 668688 | 3/1952 | United Kingdom | 446/301 |

*Primary Examiner*—Robert A. Hafer
*Assistant Examiner*—D. Neal Muir
*Attorney, Agent, or Firm*—Hill, Van Santen, Steadman & Simpson

[57] ABSTRACT

An amusement device in the form of an openable box is provided wherein a top half and bottom half of the box are formed separately and a hinge member is also formed separately so that the box halves can be interchanged with other box halves to change the exterior appearance of the device. The hinge member may also include a noise maker which is activated by opening and closing of the two box halves to increase the amusement level of the device.

19 Claims, 1 Drawing Sheet

FIG. 1
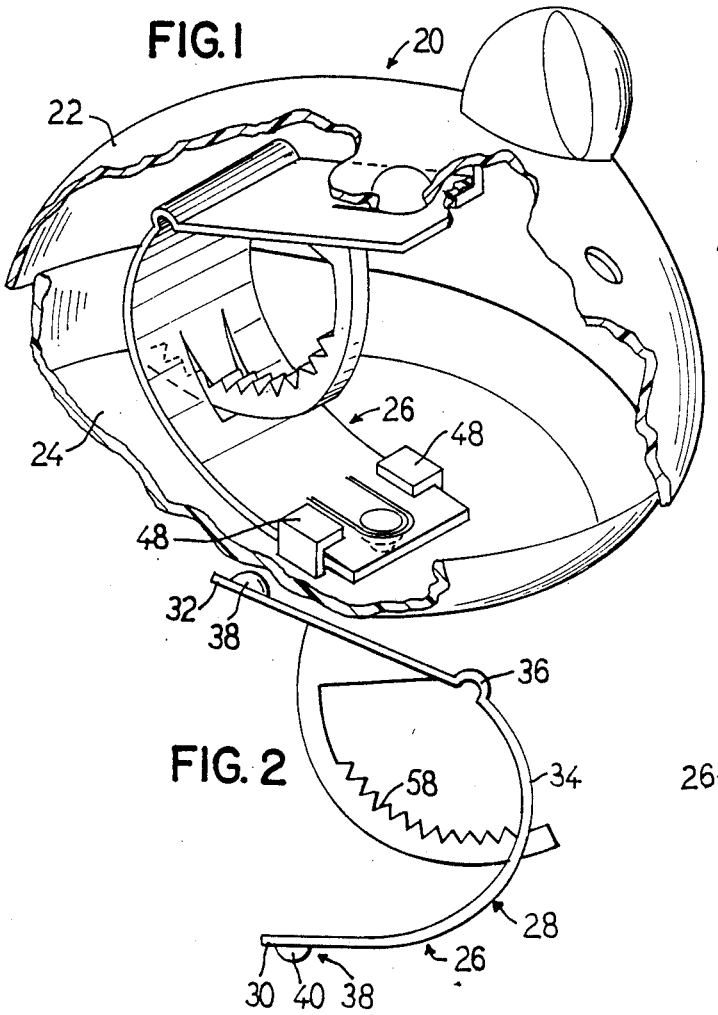
FIG. 2
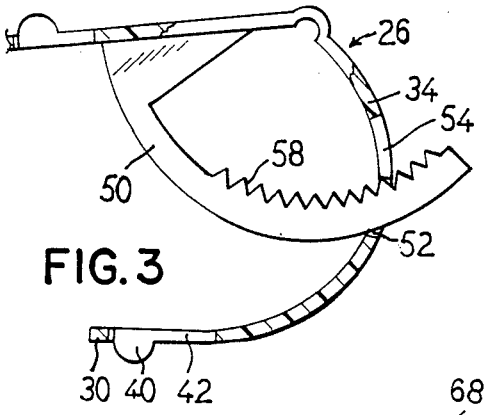
FIG. 3
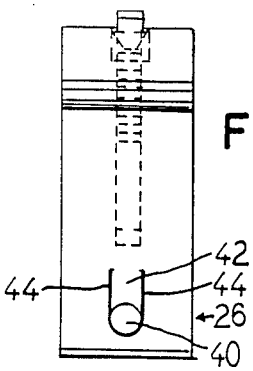
FIG. 6
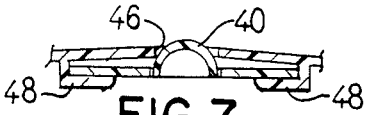
FIG. 7
FIG. 4
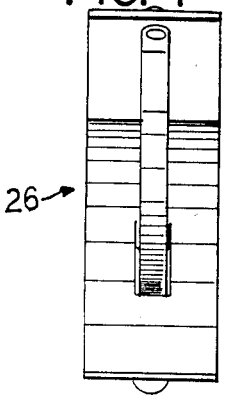
FIG. 5
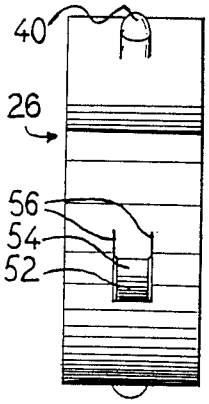
FIG. 8
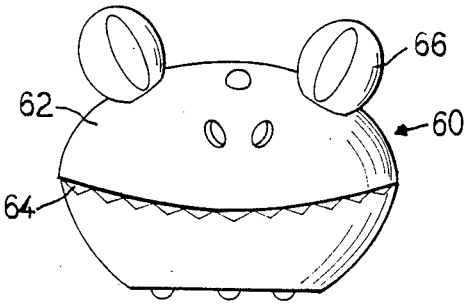
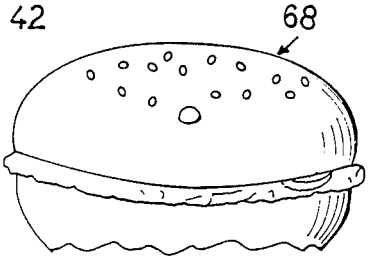
FIG. 9
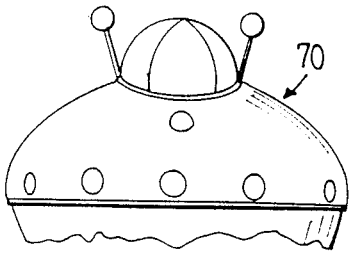
FIG. 10

LIVING HINGE BOX WITH REMOVABLE AND INTERCHANGEABLE TOP AND BOTTOM

BACKGROUND OF THE INVENTION

The present invention relates to amusement devices and more particularly to an amusement device in the shape of an openable box which includes a noise maker.

Various types of amusement devices are known in the art including boxes having decorative exteriors which may be selectively opened by a user. However, such boxes generally are formed either as a single piece with a connecting hinge, or as two pieces with a snap together hinge and merely have a hollow interior.

SUMMARY OF THE INVENTION

The present invention provides an amusement device comprising a box formed of a separate top half and bottom half. A third, living hinge piece can be snapped or fitted into place in a removably secure manner in both top half and bottom half to join them together. The living hinge member may include a ratchet tooth noise making device such that when the box is opened or closed a ratcheting noise is produced.

Since the top and bottom portions of the box are removable from the living hinge, different tops or bottoms can be interchanged to provide a variety of appearances of the box. Different external features on the box halves such as eyes and ears can give the appearance of, for example, an animal head and, as the box is opened, it will appear that it is the animal's mouth which is opening. Other appearances such as space ships and sandwich-type foods items, as well as many other types of appearances can be provided. The noise produced with the opening and closing of the box provides an added level of amusement.

BRIEF DESCRIPTION OF THE DRAWINGS

FIG. 1 is a perspective view, partially cut away of an amusement device incorporating the principles of the present invention.

FIG. 2 is a side elevational view of the hinge member shown in FIG. 1.

FIG. 3 is a sectional view of the hinge member of FIG. 2.

FIG. 4 is a front elevational view of the hinge member taken from the left side of FIG. 2.

FIG. 5 is a rear elevational view of the hinge member taken from the right side of FIG. 2.

FIG. 6 is a top elevational view of the hinged member taken from above FIG. 2.

FIG. 7 is a sectional view of the hinged member captured in the box of FIG. 1.

FIG. 8 is a front elevational view of an embodiment of the exterior appearance of the box.

FIG. 9 is a partial elevational view of a different embodiment of the external appearance of the box.

FIG. 10 is a partial elevational view of a different embodiment of the external appearance of the box.

DETAILED DESCRIPTION OF THE PREFERRED EMBODIMENTS

In FIG. 1 there is illustrated an amusement device generally at 20 which is in the form of an openable box having a top half 22, a bottom half 24 and a separate hinge member 26. The top and bottom halves are preferably made of plastic, and are easiest to close and lock if made out of a soft pliable plastic such as soft polyvinyl chloride. Such materials can be run in different colors and can also be painted or stencilled. The hinge member is preferably made of a bendable plastic such as polypropylene.

The hinge member 26 is shown in greater detail in FIGS. 2–6 where it is seen that the hinge member 26 is formed of a generally U-shaped member 28 having a first free end 30 and a second free end 32 connected by a curved bight 34. The U-shaped member is formed of a generally wide and thin strip of material with the first and second ends 30, 32 being relatively flat along their length and with only the bight portion being curved. A flexible hinge area 36 is provided at the junction between the second end 32 and the bight 34 so that the hinge member 26 will easily pivot at that point.

Both the first end 30 and second end 32 have a retention means 38 which is engageable with the top and bottom halves 22, 24 of the box 20. Although the retention means illustrated is in the form of a button 40 carried at the end of a finger 42 formed by slots 44 in the flat end portions 30, 32, a number of other types of retention means could be utilized including spaced bumps, holes with undercuts, reversible wedges and other known releasable retention arrangements.

The retention means illustrated permits a resilient snapping of the button into an aperture 46 (FIG. 7) formed in either the top or bottom half 22, 24 of the box. Retaining arms 48 are formed integrally with both the top and bottom halves and are positioned laterally adjacent the aperture 46 to receive the strip-like end of the hinge member. Thus, as the strip is inserted between the arms 48, the button 40 is deflected on the end of the finger 42 and, upon reaching alignment with the aperture 46, the button is biased into the aperture to provide a locking of the hinge onto the top or bottom half of the box. The button 40 protrudes through the aperture 46 and is exposed at the top and bottom sides of the box to permit the hinge to be selectively removed from engagement with the box by depressing the button to permit the hinge member to be slid away from engagement with the arms 48. Thus, the top and bottom halves can be selectively interchanged with other top or bottom halves to change the overall appearance of the box.

The hinge member 26 further may include a noise producing means such as the ratchet mechanism illustrated in FIGS. 2–6. As seen in those figures, an arcuate arm 50 depends downwardly from the planar portion of the second end 32 and curves rearwardly to extend through an aperture 52 formed in the bight portion 34 of the hinge member. A flexible plate 54 is provided above the aperture 52 and is defined by a pair of side slots 56 formed as extensions of the aperture opening 52. The arcuate arm 50 has on a top surface thereof a plurality of ratchet teeth 58 which engage the flexible plate 54. When the hinge member is flexed between an open and closed position, such as between the position shown in FIGS. 2 and 3, the movement of the ratchet teeth 58 relative to the plate 54 causes an intermittent engagement between the teeth and the plate, flexing the plate from an at rest position, and, upon disengagement of the teeth and plate, the plate snaps back to its at rest position to strike an adjacent tooth to produce a clacking or ratcheting sound. This sound can be varied by altering the configuration of the ratchet teeth 58 as well as by altering the length and stiffness or thickness of the plate 54. Thus, as the box is opened and closed a ratcheting sound is produced.

Various configurations of the top and bottom halves can be constructed or provided within the scope of the present invention. FIGS. 8, 9 and 10 illustrate various exterior configurations, FIG. 8 illustrating a configuration 60 in which the box is made to resemble the head 62 and mouth 64 of an animal so that as the box is opened, it appears that the mouth is opening and in the inside of the box becomes the inside of the mouth. Various inserts or attachments, such as eyes 66, can be molded out of separate pieces of plastic, in the same or different colors and snapped, melted or glued into place. Alternatively these items can be molded as a part of the contour of the box.

FIG. 9 illustrates a configuration 68 in Which the box appears to be an edible object, such as a hamburger. Other types of food items could also be formed. FIG. 10 illustrates yet another type of play object in the form of a flying saucer 70, and it can be appreciated that many other types of play items such as airplanes or automobiles could be provided as well. Further, any other type of object could be depicted as the exterior appearance of the box including awful looking creatures such as spiders and creepy crawlers, etc. or, virtually any other object. The tops and bottoms can be individually interchanged to provide a varying appearance of the box, and the noise producing means provides an added level of amusement. Also, the size of the box can vary as can the top half, bottom half and the hinge member.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim:

1. A box comprising a plurality of first halves;

a plurality of separate second halves;

a biased over separate hinge member connected to one of said first halves and a selected one of said second halves to permit said first and selected second halves to be opened and closed in a pivoting manner, said hinge member comprising a sounder operating when said first and second halves are moved relative to one another; and means for selectively interchanging different ones of said second halves for selected second half.

2. A box according to claim 1, wherein said hinge member includes means for producing noise as said first and second halves are opened and closed.

3. A box according to claim 2, wherein said means for producing noise comprises a first part of said hinge member being in interfering engagement with a second part of said hinge member, such that as said box is opened and closed, said first and second parts rub against one another to produce a noise.

4. A box according to claim 1, wherein an outside of said first half has a configuration which is different than a configuration of an outside of said selected second half.

5. A box according to claim 4, wherein separate decorative pieces are permanently attached to said first half to alter the appearance thereof.

6. A box according to claim 1, wherein said hinge member and said box halves include integrally formed cooperating portions of a retention means such that said hinge member is removably connected to said first and selected second halves without any separate fasteners.

7. A box according to claim 1, wherein said first and second halves are molded from a soft pliable plastic material.

8. A box according to claim 1, wherein said hinge member is molded from a bendable plastic material.

9. A box comprising:

a top half;

a separate bottom half;

a separate hinge member connected to said top and bottom halves to permit said top and bottom halves to be opened and closed in a pivoting manner;

said hinge member being removably connected to said top and bottom halves and including means for producing noise as said top and bottom halves are opened and closed;

said means for producing noise comprising a first part of said hinge member being in interfering engagement with a second part of said hinge member, such that as said box is opened and closed, said first and second parts rub against one another to produce a noise, wherein a series of rachet teeth are formed on one of said parts and a resilient plate comprises the other of said parts such that as said box is opened and closed, said ratchet teeth intermittently engage and flex said resilient plate from an at rest position and said plate snaps back to its at rest position upon disengagement with a ratchet tooth to strike an adjacent tooth to produce a noise.

10. An amusement device comprising:

a plurality of first members, a plurality of separate second members, a separate noise producing member attached to one of each of said first and second members, said noise producing member including a means for producing noise as said first and second members are moved relative to one another, said means for producing noise comprising a first part of said noise producing member being in interfering engagement with a second part of said noise producing member, such that as said first and second members move relative to one another, said first and second parts rub against one another to produce a noise.

11. An amusement device according to claim 10, wherein said first and second members can be moved to an overlying relationship upon sufficient flexing of said noise producing member.

12. An amusement device comprising:

a first member, a separate second member, a separate flexible connecting member attached to said first and second member to permit said first and second members to move relative to one another, said connecting member including a means for producing noise as said first and second members are moved relative to one another, said means for producing noise comprising a first part of said connecting member being in interfering engagement with a second part of said connecting member, such that as said first and second members move relative to one another, said first and second parts rub against one another to produce a noise.

13. An amusement device according to claim 12, wherein a series of rachet teeth are formed on one of said parts and a resilient plate comprises the other of said parts that as said members are moved relative to one another, said rachet teeth intermittently engage and flex said resilient plate from an at rest position and said plate snaps back to it at rest position upon disengagement with a ratchet tooth to strike an adjacent tooth to produce a noise.

14. An amusement device comprising:

a first member, a separate second member, a separate flexible connecting member attached to said first and second member to permit said first and second members to move relative to one another, said connecting member including a means for producing noise as said first and second members are moved relative to one another, said connecting member being removably attached to said first and second members to permit said members to be interchanged with different members.

15. An amusement device according to claim 14, wherein said connecting member and said first and second members include integrally formed cooperating portions of a retention means such that said connecting member is removably connected to said first and second members without any separate fasteners.

16. An amusement device according to claim 15, wherein an outside of said top half has a configuration which is different than a configuration of an outside of said bottom half.

17. An amusement device according to claim 16, wherein said top and bottom halves are molded from a soft pliable plastic material.

18. An amusement device according to claim 15, wherein separate decorative pieces are permanently attached to said top half to alter the appearance thereof.

19. An amusement device in the form of a box, comprising:

a top half, a separate bottom half, a separate hinge member connected to said top and bottom halves to permit said top and bottom halves to be opened and closed in a pivoting manner, said hinge member and said box halves including integrally formed cooperating portions of a retention means such that said hinge member is removably connected to said top and bottom halves without any separate fasteners to permit said top and bottom halves to be interchanged with different box halves, said hinge member being molded from a bendable plastic material and further including means for producing noise as said top and bottom halves are opened and closed, an outside of said top half having a configuration which is different than a configuration of an outside of said bottom half.

* * * * *